United States Patent [19]

Tamura et al.

[11] Patent Number: 4,625,931

[45] Date of Patent: Dec. 2, 1986

[54] WEB-MEANDERING PREVENTING DEVICE

[75] Inventors: Tadashi Tamura; Reiji Kikuchi, both of Iwate, Japan

[73] Assignee: Kabushiki Kaisha Sato, Japan

[21] Appl. No.: 524,120

[22] Filed: Aug. 16, 1983

[30] Foreign Application Priority Data

Aug. 27, 1982 [JP] Japan ..... 57-128634
Feb. 28, 1983 [JP] Japan ..... 58-27101

[51] Int. Cl.[4] ..... B65H 16/04; B65H 23/08

[52] U.S. Cl. ..... 242/68.3; 242/75.4; 242/99

[58] Field of Search ..... 242/68.3, 75.4, 84.8, 242/99, 68.2

[56] References Cited

U.S. PATENT DOCUMENTS

| | | | |
|---|---|---|---|
| 2,928,620 | 3/1960 | Stavrakis et al. | 242/68.3 |
| 3,850,379 | 11/1974 | Stern | 242/75.4 X |
| 4,095,754 | 6/1978 | Campo | 242/68.3 X |
| 4,190,211 | 2/1980 | Janzen | 242/99 X |
| 4,205,804 | 6/1980 | Carlson | 242/68.3 |
| 4,322,044 | 3/1982 | Bilek | 242/75.4 |
| 4,444,364 | 4/1984 | Dahl et al. | 242/68.3 |

*Primary Examiner*—Harvey C. Hornsby
*Assistant Examiner*—Scott J. Haugland
*Attorney, Agent, or Firm*—Ostrolenk, Faber, Gerb & Soffen

[57] ABSTRACT

A device for preventing meandering or free running of a web on a roll supported on a shaft on a machine, like a thermal printer. A stationary shaft is fixed to the frame. A core is rotatably mounted around the shaft. A reel mounted around the core has a carbon ribbon that is to be wound on it or unwound from it when the reel is rotated. A leaf spring between the core and the inner circumference of the reel frictionally connects the reel and the core so that the reel does not rotate idly of the core, but rotates together with the core. The core is held by a spacer at a predetermined distance along the shaft from the machine frame. A spring acting on the opposite side of the core pushes the core toward the spacer, whereby the core is frictionally restrained from freely rotating, which prevents web meander. Felt washers disposed between the core and the elements axially adjacent thereto smooth the rotation of the core and prevent wear thereof.

13 Claims, 4 Drawing Figures

WEB-MEANDERING PREVENTING DEVICE

BACKGROUND OF THE INVENTION

1. Field of the Invention

The present invention relates to a web-meander preventing device for preventing meander or free running of a web on a roll, such as a heat-activated carbon ribbon which is used with a thermal-transfer type thermal printer.

2. Description of the Prior Art

In a thermal-transfer type thermal printer, heat-activated ink is transferred from an elongate web like web-heat-activated carbon ribbon to an elongate web of recording paper comprised of a usual material. A desired print is obtained on the paper by temporarily attaching the heat-activated carbon ribbon web to the recording paper web and by applying a thermal head to heat the carbon ribbon web. In this type of thermal printer, the respective take-up shafts of both the recording paper web and the carbon ribbon web are generally connected to a drive motor, whereas the respective supply rolls of both the recording paper web and the carbon ribbon web are held such that they can rotate with respect to their fixed shafts.

As a result, when the recording paper web and the carbon ribbon web are to be fed, the respective take-up shafts are simultaneously rotated to pull the recording paper web and the carbon ribbon web, and this takes the two webs from their respective supply rolls.

Since the respective supply rolls are rotatably held, they may be rotated excessively due to their rotation inertia during the unrolling of the recording paper web and the carbon ribbon web, so that occasionally, the two webs are unrolled or let off more than necessary. As a result, the two webs can meander and may fail to correctly overlap at a printing head, thereby causing an improper print. Of the two webs, the carbon ribbon web is of material of such low rigidity that it is most liable to meander. Therefore, it has been desired to prevent the carbon ribbon web from meandering.

SUMMARY OF THE INVENTION

The present invention solves the just described problem of the prior art. It is an object of the invention to provide a device for preventing a web from meandering or running free by regulating the free rotations of at least one of the supply roll or the take-up roll, if necessary, of the web, thereby to prevent the web from being unrolled or let off, on the one hand, or taken up, on the other hand, more than necessary or improperly.

Another object of the present invention is to provide a web-meander preventing device of the above type, which is enabled to pull the web under a predetermined constant tension even after prolonged use of the device.

The present invention provides a device for preventing a web from meandering. The device comprises a relatively stationary shaft that is fixed to the frame of the machine. A core member is rotatably mounted around the fixed shaft. A reel is mounted around the core member for the web to be wound thereon in rolled form, either for providing a supply roll or a take-up roll. The supply roll lets off the web each time it is rotated. The take-up roll receives the let off web each time the take-up roll is rotated. There are idle rotation restraining means between th core member and the reel for preventing idle rotation of the reel with respect to the core member. This comprises friction means which frictionally connect a reel and its core member to prevent the reel from idly rotating separately of the core member. The friction means are a resilient spring extending from the core member to the reel. Axial positioning means position the core member at a predetermined spacing in the axial direction of the stationary shaft from the frame of the machine. Elastic means elastically bias the core member axially of the stationary shaft toward the positioning means which the core member rubbingly engages to prevent the core member and accordingly its reel from freely rotating. This prevents the web from being freely let off from or taken up onto a roll and thereby prevents the web from meandering. Rotation smoothing means smooth the rotation of the core member relative to the axial positioning means and the elastic means while preventing the core member from wearing.

BRIEF DESCRIPTION OF THE DRAWINGS

Other objects, features and advantages of the present invention will become apparent from the following description taken in conjunction with the accompanying drawings, in which.

DESCRIPTION OF THE PREFERRED EMBODIMENT

Figure 1:
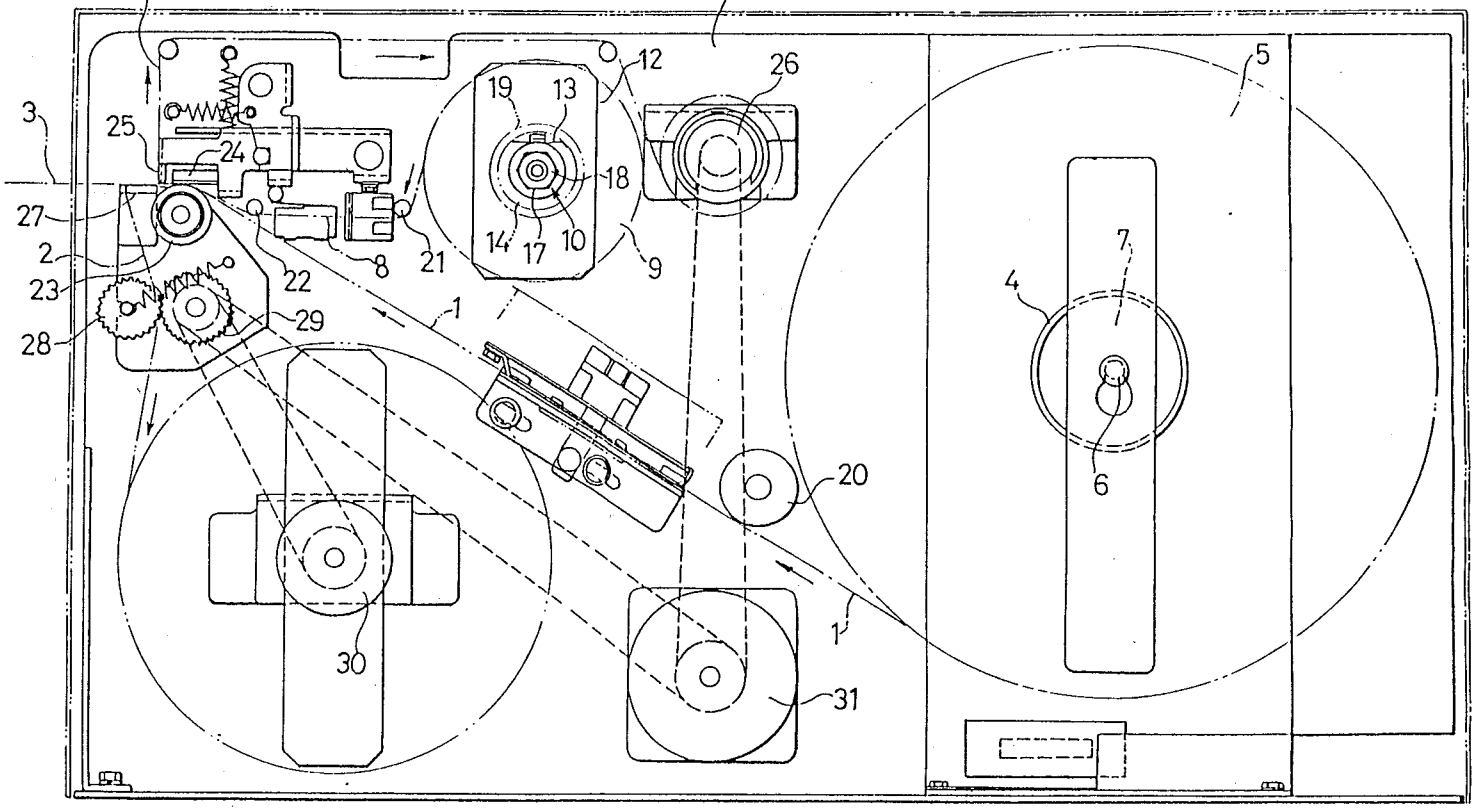
FIG. 1 is a view showing the internal mechanism of a thermal transfer type thermal printer which is equipped with one embodiment of a web-meander preventing device according to the present invention.

FIG. 1 shows a thermal transfer type thermal printer to which the web-meander preventing device of the present invention is applied. The thermal printer uses a label web 1 as its record paper. A number of labels 3 are temporarily adhered in series to an elongate web backing paper 2. The label web 1 is in the form of a label roll 5, which is wound on a reel 4 that is on a core member 7 which is rotatably mounted on a fixed shaft 6.

Figure 2:
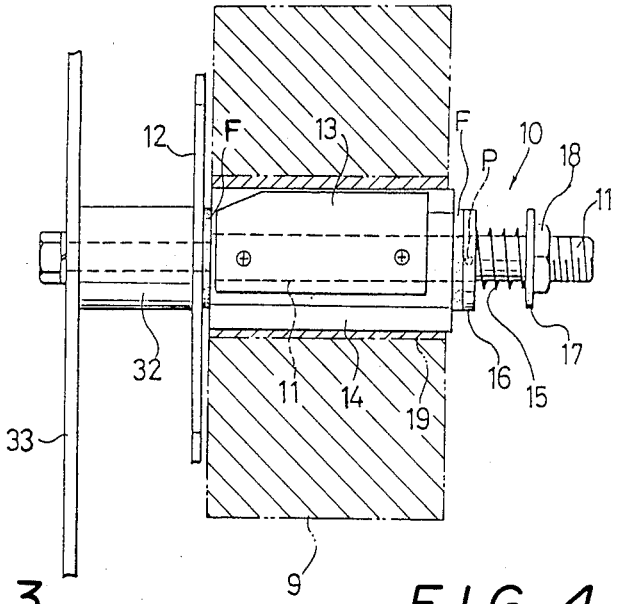
FIG. 2 is an enlarged top plan view showing a first embodiment of the meander preventing device of the present invention.
Figure 3:
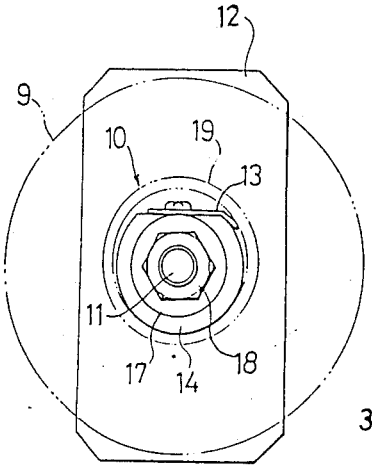
FIG. 3 is an enlarged front elevational view showing the first embodiment.

In the preferred embodiment shown in FIGS. 1–3, a supply roll 9 of a heat-activated carbon ribbon 8 is mounted on a fixed, stationary shaft 11 by a web-meander preventing device 10 of the present invention. The first embodiment of this device is now described with reference to FIGS. 2 and 3. A core member 14 for the roll 9 is rotatably mounted on the outer circumference of the stationary shaft 11. At one axial end of the core member, a metallic flange 12 is formed, which acts as an abutment member for holding one side of the supply roll 9. A spacer 32 is sandwiched between the frame 33 of the thermal printer and the flange 12 at the end of the core member 14. On the outer circumference of the stationary shaft 11, there is rotatably mounted a core member 14. An idle rotation restraining or stopping friction means, in the form of leaf spring 13, is mounted on the outer circumference of the core member 14. The spring 13 has a free end that engages the interior of the reel 19 of the roll, as described below. The end of the spring is bent, so that it engages the reel obliquely for permitting reel rotation in one direction while digging into the reel and inhibiting reverse rotation. Against the other axial end of that core member 14, there abuts a collar 16, which is biased toward the frame of the machine and the spacer 32 by an elastic member, such as a thrust coil spring 15. A pin P is provided on the stationary shaft 11. A key groove (not shown) which engages with the pin P is provided in the collar 16 to enable the collar 16 to be integrated with the stationary shaft 11 in the direction of rotation, but to be movable in the axial direction of the stationary shaft 11. A collar 17 spaced from the collar 16 retains the other end of the coil spring 15. An adjusting nut 18 screwed on the leading end of the stationary shaft 11 positions the collar 17 for adjusting the biasing force of the coil spring 15.

Between the core member 14 and the collar 16 and between the core member 14 and the flange 12, respectively, there are sandwiched rotation-smoothing means, such as washer-shaped members F, which are made of a material, e.g., felt, that is softer than the flange 12, core member 14 and collar 16 which the members F abut.

An alternate embodiment of meander preventing device differs with respect to certain of the features just described. Those differences can be seen only in FIG. 4, which replaces FIG. 2 for this embodiment. This embodiment appears the same in the views of FIGS. 1 and 3. In this alternate embodiment, a supply roll 9 of a heat-activated carbon ribbon 8 is mounted on a fixed, stationary shaft 11 by a web-meander preventing device 10, which is now described with reference to FIGS. 2 and 3. A core member 14 for the roll 9 is rotatably mounted on the outer circumference of the stationary shaft 11. The core member 14 is formed at one axial side with a flange 12 for holding one side of the supply roll 9. A spacer 32 is sandwiched between the frame 33 of the thermal printer and the flange 12 at the end of the core member 14. An idle rotation restraining or stopping friction means, in the form of leaf spring 13, is mounted on the outer circumference of the core member 14 by screws. The spring restrains rotation of the roll 9, as described below. A collar 16 abuts against the other side of the core member 14 from the flange 12. The collar 16 is biased by an elastic member, such as a thrust coil spring 15, toward the flange 12. Another collar 17 retains the other end of the coil spring 15. An adjusting nut 18 screwed on the leading end of the stationary shaft 11 adjusts the biasing force of the coil spring 15. The primary difference between this embodiment and the first is the absence of the rotation smoothing means, members F.

The following description applies to both of the embodiments.

The carbon ribbon 8 is wound in the form of the supply roll 9, which is taken up on a reel 19, upon the outer circumference of the core member 14. The supply roll 9 and the core member 14 are rotated together due to the friction connection which is established between the leaf spring 13 of the core member 14 and the inner circumference of the reel 19.

Next, the label web 1 is guided by guide roller 20, while the carbon ribbon 8 is guided through guide rollers 21 and 22. The label web and carbon ribbon are temporarily attached to each other just upstream of a platen roller 23. After the web and ribbon come together, the carbon ribbon 8 passes a thermal head 24 and is turned upward at a holding member 25 until it is finally taken up on a carbon ribbon take-up shaft 26.

The label web 1 is turned and deflected at the leading end of a turning member 27 to advance only its backing paper web 2 downward. After that, the backing paper 2 passes through a pair of toothed rollers 28 and 29 until it is taken up on a backing paper take-up shaft 30. Meanwhile, the labels 3 are allowed to move forward, while being peeled off at the turning member 27 from their backing paper 2, until the labels are brought into states in which they can be applied to articles such as commodities.

A drive motor 31 is connected through respective belts to the carbon ribbon take-up shaft 26 and the toothed roller 29, and the latter is, in turn, connected to the backing paper web take-up shaft 30.

The operation of the web-meander preventing device is now described. In the thermal printer, the exothermic element of the thermal head 24 generates heat in response to an instruction from a control circuit (not shown) to melt the heat-responsive ink of the heat-activated carbon ribbon 8 so that the melted ink is transferred to the labels 3 of the label web 1 which produces the desired prints on the labels. When the label web 1 and the carbon ribbon 8 are to be fed, the backing paper take-up shaft 30, the toothed roller 29 and the carbon ribbon take-up shaft 26 are driven by the drive motor 31, thereby to feed and take up the label web 1 and the carbon ribbon 8 at an identical speed.

At this time, moreover, the web-meander preventing device 10 of the present invention operates at the supply roll 9 of the carbon ribbon 8.

In the first embodiment of FIG. 2, the core member 14 is prevented from freely rotating because it is thrust toward the spacer 32 through the flange 12, the washer-shaped members F and the collar 16 due to the bias of the thrust coil spring 15. Moreover, the supply roll 9 rotates together with the core member 14 by the idle-stopping leaf spring 13 on the core member engaging the reel 19 of the roll 9, as described above.

When the carbon ribbon 8 is to be fed, the portion thereof to be taken up on the carbon ribbon take-up shaft 26 is unrolled or let off from the supply roll 9. In this case, the core member 14 and the supply roll 9, which are thrust by the coil spring 15, are rotated by that length of the carbon ribbon 8 which has been pulled out and let off. The combined bias of the core 14 toward the spacer 32 and frame 33 and the bias of the spring 13 act to prevent further rotation of the supply roll resulting from rotation inertia. As a result, the carbon ribbon 8 extending between the take-up shaft 26 and the supply roll 9 is properly tensioned at all times and not slackened so that it is prevented from meandering or free running. Consequently, the carbon ribbon 8 is accurately registered with the label web 1 at the printing head so that no improper print is produced.

Moreover, since the washer-smoothing members F are sandwiched between the core member 14 and the collar 16 and also between the core member 14 and the flange 12, the core member 14 is protected against wear, which might otherwise be caused by the friction between the core member 14 and the collar 16 and between the core member 14 and the flange 12. This enables the rotational torque of the supply roll 9 to be held at a constant level by the bias of the coil spring 15 at all times, even during prolonged use.

Figure 4:
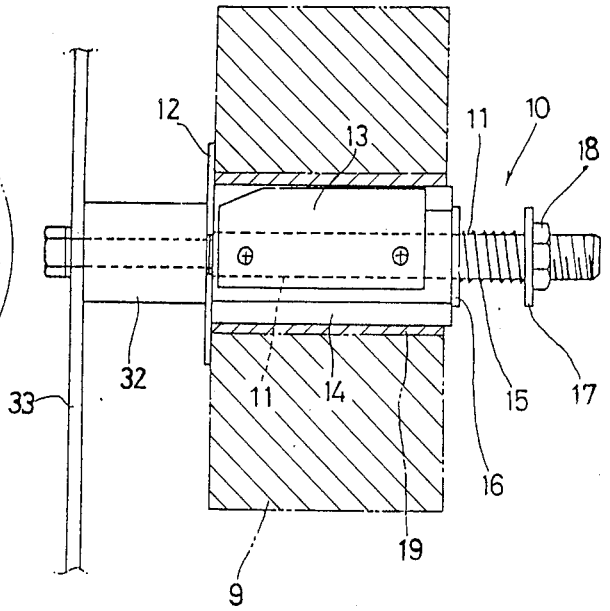
FIG. 4 is a top plan showing a second embodiment of the meander preventing device.

In the second embodiment of FIG. 4, wherein the members F are omitted, the core member 14 is prevented from freely rotating because it is thrust toward the spacer 32 through the collar 16 being biased by the thrust coil spring 15. Moreover, the supply roll 9 rotates together with the core member 14 by the idle-stopping leaf spring 13 on the core member engaging the reel 19 of the roll 9, as has been described above.

When the carbon ribbon 8 is to be fed, the portion thereof to be taken up on the carbon ribbon take-up shaft 26 is let off from the supply roll 9. In this case, the core member 14 and the supply roll 9, which are thrust by the coil spring 15, are rotated by that length of the carbon ribbon 8 which has been pulled out and let off. The combined bias of the core 14 toward the spacer 32 and frame 33 and the bias of the spring 13 act to prevent further rotation of the supply roll resulting from rotation inertia. As a result, the carbon ribbon 8 extending between the take-up shaft 26 and the supply roll 9 is properly tensioned at all times and is not slackened, so that it is prevented from meandering or free running. Consequently, the carbon ribbon 8 is accurately registered with the label web 1 at the printing head so that no improper print is produced.

The elastic member for thrusting the core member 14 need not be limited to the coil spring but may be another elastic member, such as a rubber element. Also, the washer-shaped members F need not be limited to the felt elements F. They may instead be made of cloth, etc., so long as the material is softer than the core member 14 and the elements that abut the core member, such as the flange 12 and the collar 16.

Moreover, the present invention is not limited in its application to the carbon ribbon, but it can also be applied to prevent meandering of another similar web. Furthermore, the web-meander preventing device of the present invention may be attached to the take-up roll instead of the supply roll or to both the supply roll and the take-up roll, although the foregoing description has been directed to the meander preventing device attached to the supply roll.

As has been described hereinbefore, according to the present invention, the supply roll and/or, if desired, the take-up roll can be prevented from freely rotating by the biasing thrust of the elastic member which is disposed at the side of the supply and/or take-up roll. This prevents the supply roll and/or the take-up roll from rotating any extra distance due to their rotational inertias, when the web is to be let off or taken up, so that the web can be properly tensioned at all times. As a result, the web can be prevented from meandering or running freely to obviate production of an improper print. In addition, the washer-shaped members, made of felt, for example, helps hold the rotational torque of the supply roll and/or the take-up roll at constant levels even during prolonged use.

Although the present invention has been described in connection with a number of preferred embodiments thereof, many variations and modifications will now become apparent to those skilled in the art. It is preferred, therefore, that the present invention be limited not by the specific disclosure herein, but only by the appended claims.

What is claimed is:

1. In a printing device operating in connection with a web upon a roll, means for controlling the web for preventing meandering or uncontrolled running of said web upon said roll, comprising:

a machine frame, a relatively stationary shaft fixed to the frame;

a core member rotatably mounted around the fixed shaft; a reel mounted around the core member, and the reel being adapted for having the web wound thereon in a rolled form for providing a roll of the web; the reel being rotatable on the shaft selectively to permit the web to wind off the roll and to take up the web onto the roll each time the reel is rotated;

idle rotation restraining means between the reel and the core member for preventing the reel from idly rotating separately from the core member;

axial positioning means for positioning the core member on the stationary shaft and with respect to the frame of the machine;

elastic means for elastically biasing the core member axially of the stationary shaft and toward the axial positioning means for causing such engagement between the positioning means and the core member as to prevent the core member and the reel therearound from freely rotating thereby to prevent the web from running free of the roll, or onto the roll, and hence for preventing meandering running of the web;

the idle rotation restraining means comprises friction means for frictionally connecting the reel around the core member for frictionally preventing the reel from idly rotating separately from the core member;

the reel having an inner circumference around the core member, and the friction means including an idle-stoping leaf spring secured to the core member and having a free end frictionally abutting the inner circumference of the reel; and the free end of the leaf spring being bent in a direction with respect to the reel for allowing the reel to frictionally rotate together with the core member only in one direction.

2. The device of claim 1, wherein the axial positioning means includes a spacer interposed between the frame of the machine and the core member.

3. The device of claim 2, wherein the spacer is roller shaped and is rotatably interposed between the frame and the core member.

4. The device of claim 3, wherein the elastic means connects to the core member at the opposite side thereof from the spacer.

5. The device of claim 1, further comprising roll holding means for holding one axial side of the web on the roll.

6. The device of claim 5, wherein the roll holding means includes a flange interposed between the axial positioning means and one axial side of the core member.

7. The device of claim 6, further comprising rotation smoothing means for smoothing the rotation of the core member relative to both the said axial positioning means and the said elastic means, while preventing the core member from wearing due to the rotation thereof and wherein the said rotation smoothing means includes a member which is comprised of a material which is softer than the core member and is interposed between the core member and the flange.

8. The device of claim 7, wherein the idle rotation restraining means comprises friction means for frictionally connecting the reel around the core member for frictionally preventing the reel from idly rotating separately from the core member.

9. The device of claim 7, wherein the rotation smoothing means comprises a washer-shaped member.

10. The device of claim 1, wherein the elastic means comprises a thrust coil spring mounted under compression around the stationary shaft.

11. The device of claim 10, further comprising:

a first collar mounted on the stationary shaft and disposed between and abutting against both the core member and one axial end of the coil spring;

a second collar mounted on the stationary shaft and abutting against the other end of the coil spring; and adjusting means for adjusting the axial position of the second collar for adjusting the biasing force of the coil spring.

12. The device of claim 11, wherein the adjusting means includes an adjusting nut threaded on the stationary shaft and abutting against the second collar.

13. The device of claim 11, further comprising rotation smoothing means, including a member made of a material softer than the core member and interposed between the core member and the first collar for smoothing the rotation of the core member relative to the first collar, while preventing the core member from wearing due to the rotation thereof.

* * * * *